United States Patent [19]

Chiung-Feng

[11] 4,228,551

[45] Oct. 21, 1980

[54] BABY TOILET

[76] Inventor: Lee Chiung-Feng, No. 103 Wutsang St. Sec. 2, Taipei, Taiwan

[21] Appl. No.: 23,535

[22] Filed: Mar. 26, 1979

[51] Int. Cl.[3] ..... A47K 11/02

[52] U.S. Cl. ..... 4/484; 4/449; 4/460; 4/476

[58] Field of Search ..... 4/300, 301, 307, 315, 4/116, 141, 142, 138, 1

[56] References Cited

U.S. PATENT DOCUMENTS

| | | | |
|---|---|---|---|
| 2,602,166 | 7/1952 | Aitken | 4/141 |
| 2,730,726 | 1/1956 | Babbage | 4/141 |
| 2,866,980 | 1/1959 | Huntington | 4/142 |
| 3,381,315 | 5/1968 | Glassberg | 4/142 |
| 3,401,408 | 9/1968 | Buck | 4/141 |
| 3,921,234 | 11/1975 | Mracek et al. | 4/141 X |
| 3,952,336 | 4/1976 | Kunter et al. | 4/142 |
| 4,069,522 | 1/1978 | Messmer et al. | 4/141 |

*Primary Examiner*—Henry K. Artis

[57] ABSTRACT

The present invention relates to a portable baby toilet, comprising a toilet bowl which serves also as a cover, a basal part and a handle.

6 Claims, 3 Drawing Figures

BABY TOILET

BACKGROUND OF THE INVENTION

This invention relates to a portable and collapsible toilet for babies.

A small child usually cannot control his defecation or urination, and this is especially troublesome when there is no toilet around or when he is on a trip. In view of this, it is necessary to develop a portable and collapsible toilet for children under 5 years old.

SUMMARY OF THE INVENTION

According to this invention, the toilet comprises a toilet bowl which serves also as a cover, a basal part and a handle. The toilet bowl has an outlet shaped like a short pipe, protruding downwardly from its bottom, the pipe outlet being designed to be inserted into a hole on the top of the basal part. The bowl is shaped like a regular toilet bowl and, when it is inverted, it fits perfectly onto said basal part which is a flattened U shaped body with two axially aligned holes provided on its upper and lower portions. When the inverted toilet bowl is fitted onto the basal part, the pipe outlet and said two holes are aligned axially and a L-shaped handle can pass through them with its lower end engaged with the threaded hole at the bottom of said basal part and its upper end used as a handle bar for carrying the whole toilet. On the left side of said basal part, there is a long horizontal hole bored through its lower portion, and throaded at the inner end. The threaded end of the handle can be inserted into the long hole and engages its threaded end to serve as a handle for carrying the toilet.

The features and objects of the present invention will be apparent from the following description with reference to the accompanying drawings.

DETAILED DESCRIPTION OF THE PREFERRED EMBODIMENTS

Figure 1:
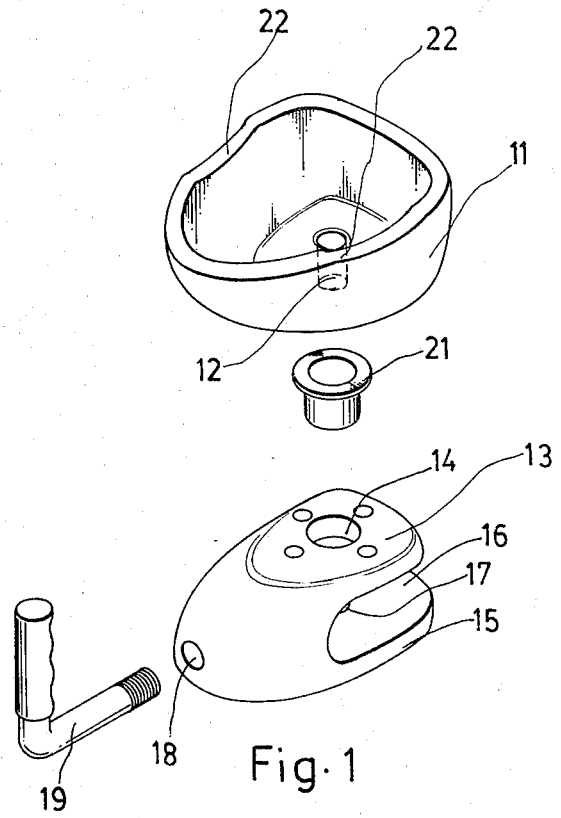
FIG. 1 is an exploded view of the baby toilet according to the present invention.

FIG. 1 is an exploded views of the baby toilet. The toilet bowl 11 has a rim whose central part 22 is depressed for a child to easily sit on it. At the bottom of the bowl there is a pipe outlet 12 protruding outwardly and downwardly for fitting into the hole 14 on the upper portion 13 of the toilet's basal part which has a flat bottom 15. There is a U shaped recess 16 between the upper and the lower portion of the basal part. A threaded hole 17 on the bottom portion aligns axially with a hole 14 on the upper portion 13. On the left side of the flattened U shaped basal part, there is a long hole 18 which is threaded at its inner end to engage the threaded end of a handle 19 which is used to carry the toilet.

Figure 3:
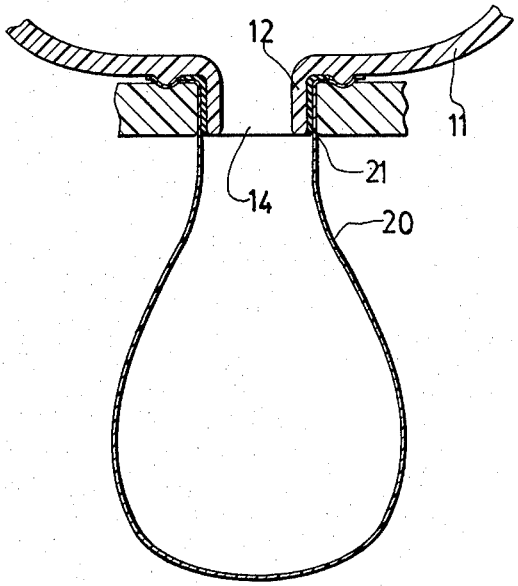
FIG. 3 is a sectional view showing partially the bowl, the hollow stopper, the basal part and the plastic bag and their relationship of engagement.

In FIG. 3, the open end of a plastic bag 20 is pushed through the hole 14 to cover its adjacent margin and is secured to the basal part by a hollow stopper 21. Said plastic bag 20 is provided to receive excretion and urine.

Figure 2:
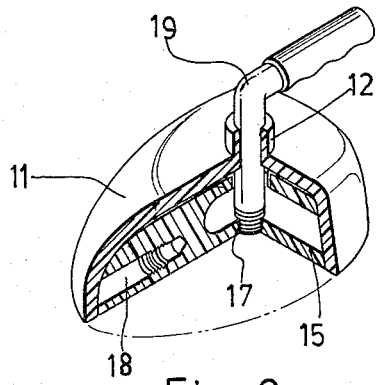
FIG. 2 is a sectional view of the baby toilet wherein various parts of the toilet are combined to form a handy unit.

FIG. 2 shows how the toilet bowl 11 is combined with the basal part and how the handle 19 is inserted through the outlet 12, hole 14, and hole 17 to be used as a handle for carrying the toilet.

To use the toilet, first fix the handle 19 in the hole 18 with the handle segment standing upright, then push the open end of a plastic bag upwardly through the hole 14 and insert the outlet 12 into the plastic bag 20 and the hole 14 so that the bag 20 is positioned and ready for use. The lower part of said bag 20 rests in said U shaped recess 16 to receive urine and excretion. After defecation or urination, the upper end of said bag 20 can be tied with a thread or a rubber band for disposal.

Referring to FIG. 3, the open end of the bag 20 is sandwiched circumferencially between the hole 14 and a hollow stopper 21 inserted into the hole, and the outlet of the toilet bowl is loaded into the hollow stopper.

To pack up the toilet, the bowl 11 should be cleaned and the handle 19 removed from the hole 18 so that the toilet bowl 11 may be inverted for fitting onto the basal part. The handle 19 is then pushed through the outlet 12, the hole 14 and the hole 17 and screwed to engage the threaded hole 17. The handle is used to carry the toilet.

Various changes may be made in the construction of the toilet without departing from the spirit and scope of the invention as defined by the appended claims.

What I claim is:

1. A portable toilet employing a flexible bag, comprising: a toilet bowl, said bowl having a flat bottom of uniform thickness, said bowl having a hole in said flat bottom and a tube extending from the outer surface of said bottom, said tube communicating with said bowl through said hole in the bottom; a base having an upper and a lower surface, said upper surface having an outer contour which is substantially identical to the inner contour of said bowl, said base having a hole therethrough from said upper surface to said lower surface located at the same position as the hole in said bowl, said hole at the upper surface of said base being of sufficient diameter to permit insertion of the tube extending from said bowl therethrough, wherein the top of the flexible bag is inserted upwardly through the hole in said base and spread partly over the upper surface of the base, said bowl being placed over the base with the tubular extension inserted into the hole in the upper surface of the base, said bowl and said base being pressed firmly together to retain the bag while the toilet is in use, and wherein said upper surface of the base is inserted into said bowl by inverting said base for transportation and storage.

2. A portable toilet, as claimed in claim 1, further comprising an L-shaped handle, one arm of said handle being provided with a gripping surface, the second arm of said handle being cylindrical and fitting inside said tubular extension on said bowl and having external screw threads at least on the end, and wherein said hole in the base is provided with a section having internal threads of matching diameter to receive said external threads on said handle, whereby, when the upper surface of said base is inserted into said bowl, said handle is inserted through said tubular extension and said holes in said bowl and said base, securing said bowl to said base by engaging said internal and external threads.

3. A portable toilet, as claimed in claim 2, wherein said base has a blind hole in an edge, said blind hole being internally threaded to receive said handle, whereby said handle is capable of being used for support of the toilet.

4. A portable toilet as claimed in claim 1, wherein the outer surface of said flat bottom of the bowl and said upper surface of the base are provided with matching projections and depressions whereby said bowl and said base are positively aligned when pressed together.

5. A portable toilet as claimed in claim 1, wherein the outer surface of said flat bottom of the bowl is provided with projections and wherein said upper surface of the base is provided with an equal number of recesses capable of receiving said projections when said tubular extension is inserted into said hole in the base, whereby said bowl and said base are positively aligned when pressed together.

6. A portable toilet as claimed in claim 1, wherein said base contains a U-shaped recess between said upper surface and said lower surface.

* * * * *